United States Patent [19]

Yacoboski

[11] Patent Number: 4,480,829

[45] Date of Patent: Nov. 6, 1984

[54] AQUATIC EXERCISING AND BODY TONING DEVICE

[75] Inventor: Anton Yacoboski, Squamish, Canada

[73] Assignee: Aquatic Exercise Products, Inc., San Rafael, Calif.

[21] Appl. No.: 495,745

[22] Filed: May 18, 1983

[51] Int. Cl.[3] ..... A63B 11/00

[52] U.S. Cl. ..... 272/116; 272/122; 272/DIG. 4; 272/93

[58] Field of Search ..... 126/290; 272/71, 1 B, 272/116, 122–124, 130–131, 93; 128/25 R; 119/29

[56] References Cited

U.S. PATENT DOCUMENTS

| | | | |
|---|---|---|---|
| 2,007,079 | 7/1935 | Cushman | 272/71 X |
| 2,064,064 | 12/1936 | Hunker | 126/290 |
| 3,913,907 | 10/1975 | Baker | 272/93 |
| 3,984,102 | 10/1976 | Evans | 272/130 |
| 4,148,479 | 4/1979 | Spector | 272/130 |
| 4,302,007 | 11/1981 | Oprean et al. | 272/116 |
| 4,311,306 | 1/1982 | Solloway | 272/122 X |

FOREIGN PATENT DOCUMENTS

| | | | |
|---|---|---|---|
| 650009 | 2/1951 | United Kingdom | 272/130 |

*Primary Examiner*—Richard J. Apley
*Assistant Examiner*—Chris Coppens
*Attorney, Agent, or Firm*—Melvin R. Stidham

[57] ABSTRACT

An exercising and body toning device for use by a person in water comprising a handle with circular resistance members fixed on opposite ends thereof. Each resistance member comprises a pair of co-axial discs with sector openings therethrough so that they may be fixed in selected relative angular positions, with the openings in adjusted registration to adjust the resistance of movement of the device through water.

2 Claims, 2 Drawing Figures

AQUATIC EXERCISING AND BODY TONING DEVICE

BACKGROUND OF THE INVENTION

With the growing concern for physical fitness, there is an increased interest in swimming and water recreation as forms of exercise. While swimming laps in a pool is an extremely beneficial exercise, many people are inclined to consider it monotonous and inadequate for development of muscles of the upper body. Accordingly, many people are seeking other forms of physical exercise and muscle development in which to engage while enjoying the water.

OBJECTS OF THE INVENTION

It is an object of this invention to provide an arm, shoulder and upper body exercising device that can be used while one is in a swimming pool or spa.

It is a further object of this invention to provide an exercising device for development of the arms, shoulders and upper body, with means for varying the amount of physical effort needed to manipulate it.

Other objects and advantages of this invention will become apparent from the description to follow, particularly when read in conjunction with the accompanying drawing.

SUMMARY OF THE INVENTION

In carrying out this invention, I provide a barbell-shaped device, including a handle to be gripped by the user with enlargements at the opposite ends. Each enlargement comprises a pair of discs, one rotatable on the other. Sector openings through the disc can be positioned in varying degrees of registry to vary the size of the effective openings through the discs, and thereby to adjust the amount of resistance that the water presents to movement of the discs through it. Hence, rotary adjustment of the discs, varies the effective "weights" at the ends of the exerciser.

DESCRIPTION OF A PREFERRED EMBODIMENT

Figure 1:
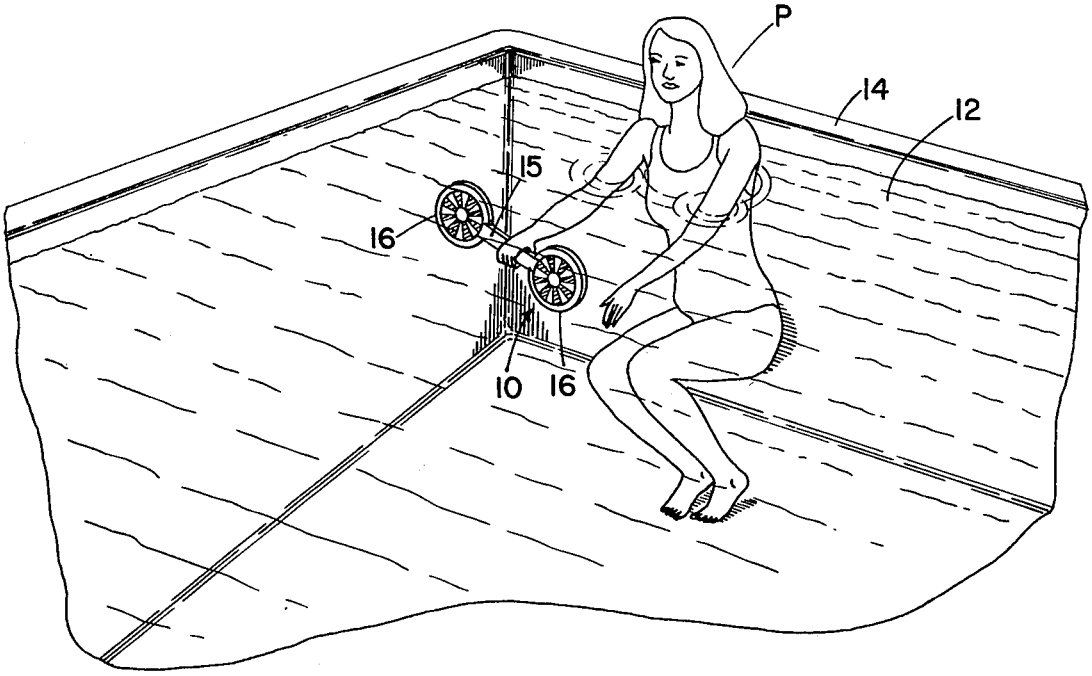
FIG. 1 is a view in perspective showing the exerciser of the invention in use.
Figure 2:
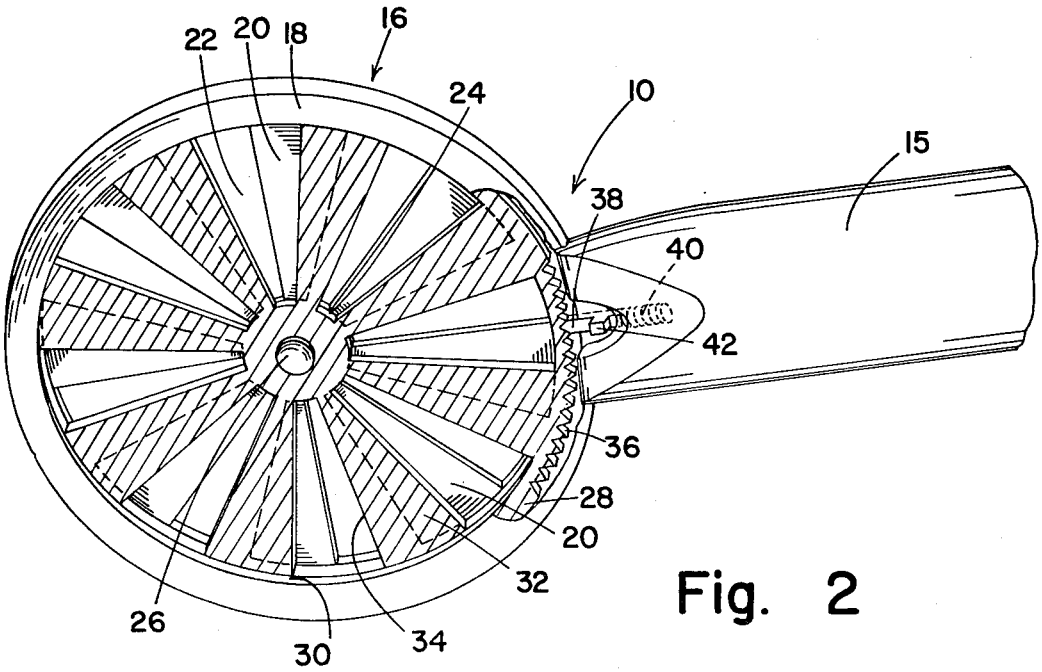
FIG. 2 is an enlarged partial view in perspective showing the means for adjusting the resistance of the device to movement through water.

Referring now to the drawings with greater particularity, the aquatic exercising device 10 of this invention is adapted to be manipulated by a person P while standing or sitting in a body of water 12, such as in a swimming pool or spa 14. Of course, it may also be used in any natural body of water, as long as the water 12 is deep enough to enable movement of the device 10 below the surface without interference.

The exercising device 10 includes a handle 15 that interconnects circular enlargements 16 at opposite ends thereof, in the general configuration of a barbell. Each circular enlargement 16 includes an outer ring 18 which may be formed integrally with a plurality of spokes or sectors 20 providing sector openings 22 between them. Near the center of the ring 16, the spokes 20 terminate in a hub 24 carrying a short spindle 26.

Rotatably carried on the spindle 26 is a second circular disc 28 which is rotatably received in a track 30 provided in the ring 18. The disc 28 also includes a plurality of solid sectors or spokes 32 with sector openings 34 therebetween.

It is obvious, that by turning the disc 28 relative to the ring 18, the sector openings 22 and 34 may be brought into varying degrees of registry, thereby to adjust the effective openings through the two discs 20 and 28.

Any suitable means may be provided for fixing the relative positions of the discs 20 and 28. For example, there may be provided a series of serrations 36 in the outer periphery of the disc 28, to be engaged by a pointed spring detent 38, which is slidable in the handle 15. The detent 38 is biased by a spring 40 into engagement with a tooth 36 aligned therewith. The detent 38 may be withdrawn by pulling on the knob 42 to retract the detent and enable partial rotation of the disc to a newly selected position. Then, the knob maybe released to enable reengagement of the detent 38, fixing the spoked wheel 28 in a newly adjusted position. The wheels 16 at the other end of the handle 15 may be adjusted in like manner to vary the total resistance of the device to movement through the water 12.

In use, a person can stand or sit in a body of water and pull the device through the water to develop arm muscles, shoulder muscles and other muscles throughout the upper body by bending, twisting and engaging in other maneuvers resisted by resistance of the water to movement of the device.

While this invention has been described in conjunction with a preferred embodiment thereof, it is obvious that modifications and changes therein may be made by those skilled in the art to which it pertains without departing from the spirit and scope of this invention, as defined by the claims appended hereto.

What is claimed as invention is:

1. An exercising device for use by a person who is positioned in water comprising:

a handle to be gripped by said person;

relatively flat, generally co-planar panels fixed to the ends of said handle, each with a generally circular surface area to resist movement thereof through water;

each said panel including a pair of relatively rigid, coaxial discs in face to face engagement;

each of said discs having a hub and an outer ring;

sector spoke members radiating outwardly from said hub at equal angles to each other connecting said hub to said outer ring thereby forming sector openings in said discs;

means for rotating one of said discs relative to the other so as to vary the registration of sector openings in one of said discs with openings in the other thereof so as to adjust the degree of resistance to movement of each of said panels through water; and means for releasably securing said one disc in a selected one of a plurality of positions relative to the other so that the relative degree of resistance thereof to said movement is visually indicated and can quickly be varied;

said handle being conditioned to be gripped at any location around the periphery thereof so that said panels can be moved through water in any plane from parallel thereto to normal thereto, further to vary their resistance to movement of said panels through water.

2. The exercising device defined by claim 1 wherein said releasable securing means comprises:

a plurality of notches on the rotatable disc; and a spring-biased member to engage a selected one of said notches.

* * * * *